United States Patent [19]

Artiano

[11] Patent Number: 4,903,845

[45] Date of Patent: Feb. 27, 1990

[54] MACHINE AND METHOD FOR SEPARATING FINES FROM WOOD CHIPS

[75] Inventor: Adrian Artiano, Mukilteo, Wash.

[73] Assignee: Acrowood Corporation, Everett, Wash.

[21] Appl. No.: 155,270

[22] Filed: Feb. 12, 1988

[51] Int. Cl.[4] ..... B07B 13/07

[52] U.S. Cl. ..... 209/671; 209/673

[58] Field of Search ..... 209/667, 668, 671, 673

[56] References Cited

U.S. PATENT DOCUMENTS

| | | | |
|---|---|---|---|
| 1,647,816 | 11/1927 | Riddell | 209/668 |
| 1,899,292 | 2/1933 | Rienks | 209/671 X |
| 2,786,574 | 3/1957 | Clark | 209/668 |
| 3,817,375 | 6/1974 | Herkes | 209/673 |
| 3,848,741 | 11/1974 | Haley et al. | 209/668 |
| 4,209,097 | 6/1980 | Nordmark et al. | 209/668 |
| 4,452,694 | 6/1984 | Christensen et al. | 209/667 X |
| 4,600,106 | 7/1986 | Minardi | 209/668 X |

FOREIGN PATENT DOCUMENTS

| | | | |
|---|---|---|---|
| 3027651 | 3/1982 | Fed. Rep. of Germany | 209/668 |
| 1227263 | 4/1986 | U.S.S.R. | 209/673 |
| 86/1580 | 3/1986 | World Int. Prop. O. | 209/667 |

*Primary Examiner*—Joseph J. Rolla

*Attorney, Agent, or Firm*—Seed and Berry

[57] ABSTRACT

Fines are separated from wood chips by feeding the chips onto the infeed end of a bed formed by a plurality of knurled rollers separated by narrow gaps and rotated in the same direction. The chips are tumbled by the knurls, and the fines settle into the spaces between the knurls and in the gaps to pass downwardly out of the bed for collection. As the chips tumble, they gradually move to a discharge end of the bed and discharge for further processing.

30 Claims, 5 Drawing Sheets

FIG. 5
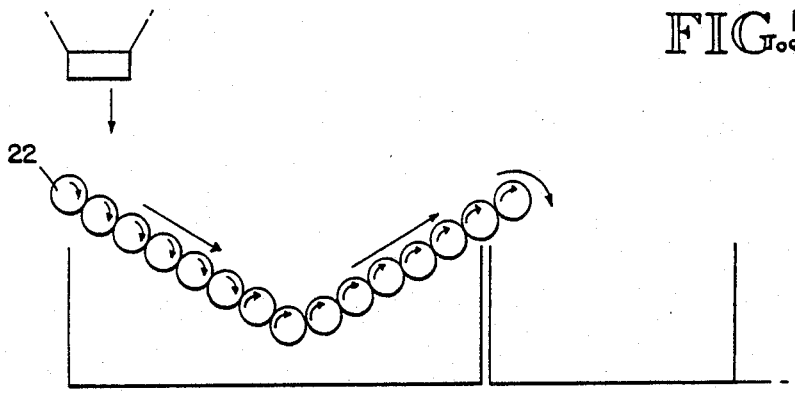
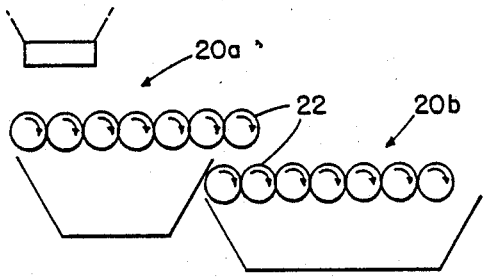
FIG. 6
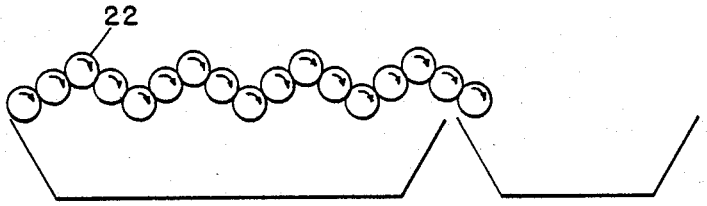
FIG. 7
FIG. 8
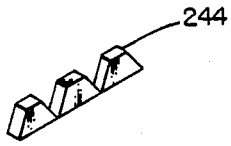
FIG. 9
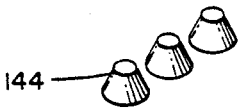

FIG. 10
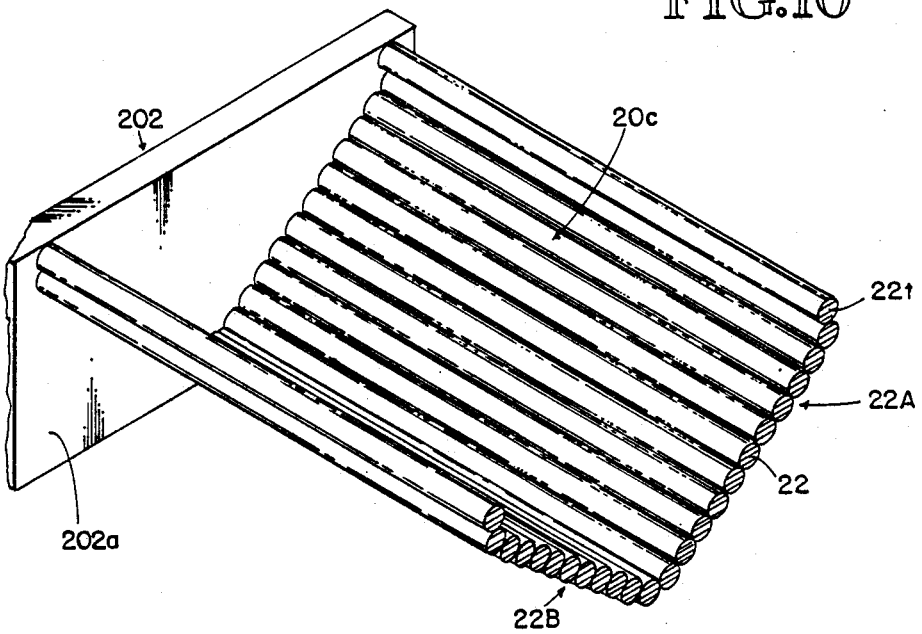
FIG. 11
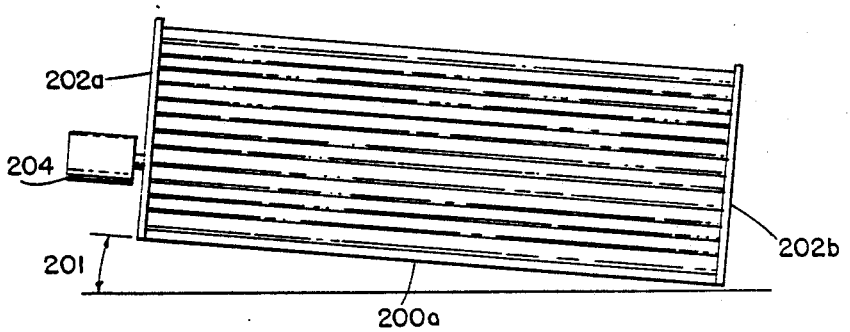
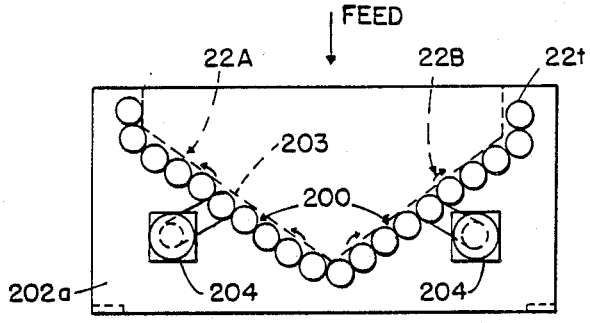
FIG. 12

MACHINE AND METHOD FOR SEPARATING FINES FROM WOOD CHIPS

TECHNICAL FIELD

The present invention relates to the sorting of materials such as wood chips, and more particularly, to a machine and method for removal of fines not suitable for the ultimate use of the material.

BACKGROUND ART

In the processing of wood chips preparatory to introduction to a digester, it is preferred to discard those chip particles which have fibers shorter than a preset minimum length or which are in the form of flakes thinner than a preset thickness, because these are considered to be poor digesting materials. For purposes of the present description, such undesired chip particles and flakes will be called "fines."

Previously, various filtering and sorting machines have been used for removing fines, such as, for example, gyrating screens. However, these machines have been relatively inefficient respecting the percentage of fines removed and have been relatively expensive as compared to the advantage gained by removal of fines.

Accordingly, the present invention aims to provide an improved sorting machine of relatively simple, compact and economical construction which will efficiently and economically remove fines from wood chips or the like in an effective, continuous process.

DISCLOSURE OF THE INVENTION

In carrying out the invention, there is utilized a plurality of side-by-side, knurled rollers which collectively provide a bed for receiving the wood chips from which the fines are to be removed. These knurled rollers are rotated in the same direction so that the knurls on the rollers function to tumble and convey the chips along the bed.

The spaces between the knurls are sized to receive primarily the fines having too short a fiber length, and the rollers are preferably spaced apart at their maximum diameter by a gap sufficient to pass the fines having the form of flakes which are too thin. As the rollers rotate, the fines occupying the spaces between the knurls and between the rollers pass downwardly from the roller bed and discharge into a hopper or onto a discharge conveyor. The tumbling of the chips by the knurls causes the fines to settle between the knurls and between the rollers for discharge. At the same time, the tumbling chips are conveyed by the rotating roller action along the bed for discharge from one end of the roller bed into a second hopper or onto another discharge conveyor, or they can be discharged directly to a sorter for further grading the chips. The grading steps are normally continued until only chips considered too large for digestion remain. These can then be reprocessed into smaller chips suitable for digesting.

BRIEF DESCRIPTION OF THE DRAWINGS

FIGS. 5, 6 and 7 are side views illustrating alternative roller arrangements;

FIGS. 8 and 9 are perspective views showing alternative knurl shapes;

FIG. 10 is a perspective view showing a modified trough-like arrangement of knurled rollers;

FIG. 11 is a side elevational view of the trough-like arrangement;

FIG. 12 is a rear elevational view of the trough-like arrangement;

BEST MODE FOR CARRYING OUT THE INVENTION

Figure 1:
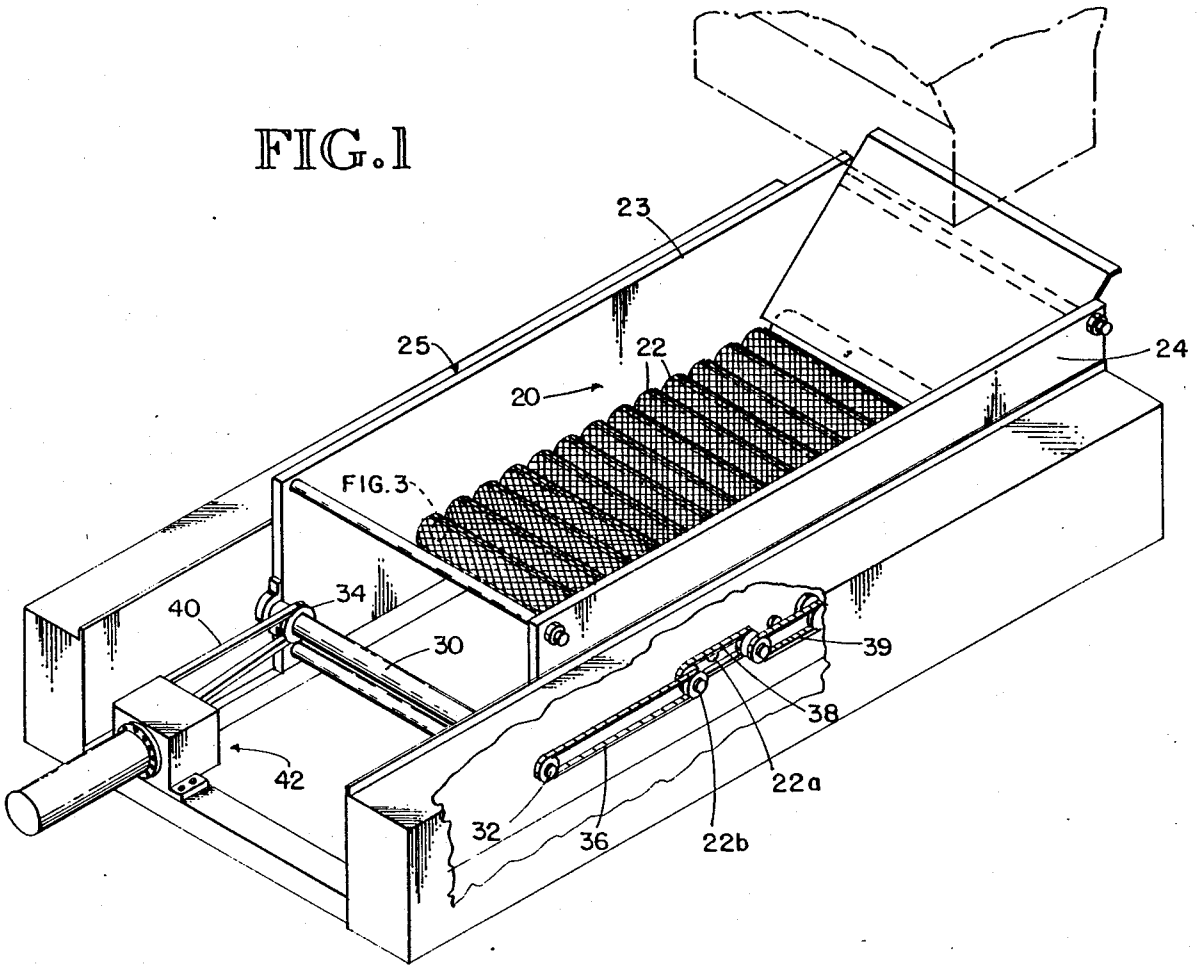
FIG. 1 is a top perspective of a machine embodying the present invention.
Figure 2:
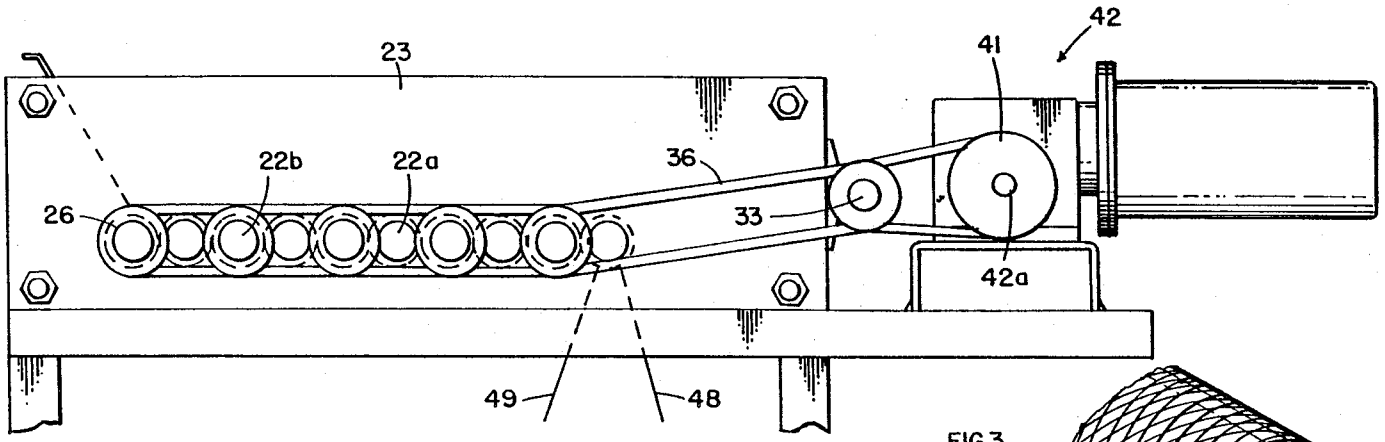
FIG. 2 is a side elevational view of the machine as viewed from the left in FIG. 1 and without a side cover plate.
Figure 4:
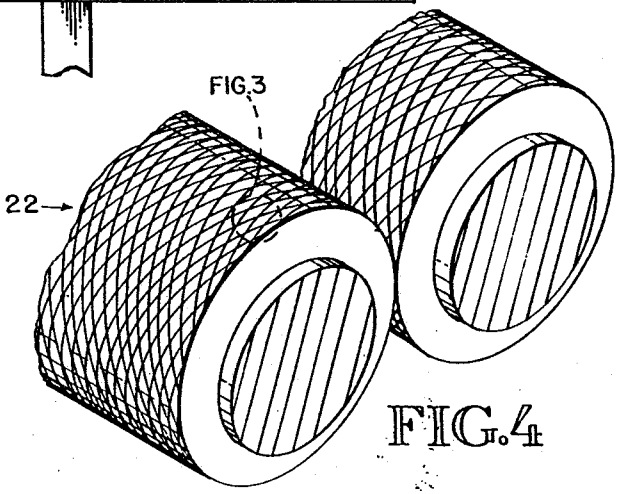
FIG. 4 is a fragmentary perspective view showing end portions of two of the knurled rollers.

Referring to the drawings, a bed 20 is formed by a plurality of side-by-side, knurled rollers 22 which have parallel rotary axes. These rollers are journal-mounted between upstanding side plates 23, 24 provided as part of a framework 25. The rollers 22 are necked at each end, and the necks 22*a*, 22*b* extend through bearings mounted in the side plates 23, 24. Neck 22*b* of each roller 22 is extended relative to neck 22*a* to receive a single sprocket 26 in the case of the two rearmost rollers and to receive inner and outer sprockets 27, 28 in the case of the other rollers.

It will be noted that alternate of the rollers 22 is reversed endwise so that there are two sets of sprockets, one set being outboard of side plate 23 and the necks 22*a* of the second set, and the second set being outboard of side plate 24 and the necks 22*a* of the first set. At the forward end of the side plates 23, 24, there is mounted a cross-shaft 30, in turn having end sprockets 32, 33 and an intermediate sprocket 34. The end sprockets are connected by chains 36 to the most forward outer sprocket 28 on the respective side of the machine. Alternating inner and outer chains 38, 39 then alternately connect the inner and outer sprockets to drive alternate of the rollers 22 at one side of the machine and to drive the other rollers at the other side of the machine from the shaft 30. The latter is in turn powered by a chain 40 from a drive sprocket 41 on the output shaft 42*a* of a variable-speed drive unit 42 mounted at the front of the framework 25. The described drive arrangement permits rollers with a relatively small diameter, such as, for example, 2.187 inches, and which are close together to be used and driven in a simple manner in the same direction of rotation from a single motor.

As part of the present invention, the rollers 22 are preferably provided with knurls 44, which extend as protuberances from a minimum outside radius to a maximum outside radius of the rollers and may have a generally pyramidal shape. These knurls may be formed by routing two sets of vee-grooves 45, 46 of opposite hand in crisscrossing spiral paths along the length of the rollers starting from opposite ends. Each of the vee-grooves in each set may have a mouth width of 0.25 inch and a depth of 0.10 inch. The lead angle on the spiral cuts may be 27 degrees, for example.

Figure 3:
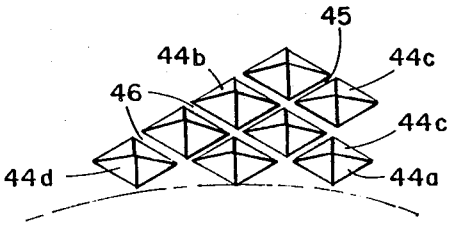
FIG. 3 is a detail view of the roller knurls taken as indicated in FIG. 4.

Referring to FIG. 3, one of the vee-grooves 45 results in the generally triangular, opposed faces 44*a*, 44*b* and one of the vee-grooves 46 results in the generally triangular, opposed faces 44*c*, 44*d*. Each of the knurls 44 is hence formed by two adjoining vee-grooves 45 and two adjoining vee-grooves 46.

The spaces (valleys) between the knurls are designed to receive fines of the type having too short a fiber. In the described example, these would be fines in which the fibers are only about 0.25 inch long. In this regard, it will be appreciated that because of the gap between the rollers, a fine does not have to fit entirely between knurls in order to pass between rollers; i.e., a fine can be partway between knurls and partway into the gap.

To screen fines which will not fit between knurls, it is preferred that the rollers 22 be spaced apart at the tips 44*e* of the knurls 44 by a gap having as its width the minimum dimension of the fines to be sorted out. In the described example, the gap is preferably about 0.06 inch. In other words, the roller axes are space apart 2.250 inches when the roller diameter is 2.187 inches. Providing such a gap permits fines such as a flake too large to fit between knurls, but having a thickness less than about 0.06 inch, to pass through the gap between adjoining rollers.

Chips being processed are fed onto the rear portion of the bed from an overhead hopper or chute (not shown) and are confined by the side walls and a sloped rear wall 46. The chips are tumbled by the knurls on the rotating rollers 22 and are gradually simultaneously conveyed by the rollers to the forward end of the bed 20 to discharge therefrom into a hopper or onto a discharge conveyor, for example. As the chips tumble and move toward the forward end of the roller bed, the fines settle between the knurls and/or in the gaps between the rollers and pass downwardly out of the bed for discharge into a hopper or onto a suitable conveyor (not shown). In this regard, forwardly and rearwardly sloping diverters 48, 49 are preferably provided beneath the front roller to guide the discharging fines and chips and keep them separated.

The bed of rollers may be flat, i.e., the roller axes are in a horizontal plane, or may have a vee configuration (FIG. 5) or a vertically zigzagging configuration (FIG. 7). Also, the rollers can be arranged in stages so that there is a first bed 20*a* which cascades at its forward end onto a second roller bed 20*b*. In this regard, after the fines are removed, the chips can discharge onto a roller bed which has its rollers spaced apart by a gap corresponding to a maximum desired chip thickness so that the only chips which exceed this thickness will remain on the bed for discharge at its forward end for further grading or reprocessing to a smaller size.

Referring to FIGS. 10–12, a further alternative arrangement for use of the knurled rollers 22 is shown in which two banks 22A and 22B of side-by-side rollers 22 are arranged to provide a trough-like bed 20*c* having a generally vee-configuration in which the plane defined by the rotary axes of the bank 22A forms a dihedral angle 200 with the plane defined by the rotary axes of the other bank 22B. The vertex line 200*a* of this dihedral angle 200 slopes downwardly from a rear infeed end in the forward direction, as indicated by angle 201 in FIG. 11. This angle 201 may be made adjustable and may be about 15 degrees. It is preferred to have an upper knurled roller 22*t* in each bank 22A, 22B arranged with its rotary axis in a vertical plane containing the rotary axes of the adjoining roller in the respective bank so that chip material will not climb over the top of the banks.

The rollers 22 in the bed 20*c* are journal-mounted in a frame 202 having a back wall 202*a* and a front wall 202*b*. The front wall has a vee-shaped cutout for chip discharge, as indicated by the broken line 203 in FIG. 12.

The rollers in the banks 22A, 22B are driven in opposite directions by motors 204 at the rear of the back wall 202*a* via a suitable chain and sprocket drive. The directions of rotation are such that both banks tend to move chip material fed onto the rear of the bed upwardly away from the bottom of the trough. At the same time, the forward slope of the bed, as defined by angle 201, causes the chip material to move forwardly along the respective bank of the bed. A typical chip may move in a generally sinusoidal path as it progresses along the bed 20*c* to discharge at the forward end in that when the chip has climbed upwardly on one of the banks 22A, 22B to a certain height, it will then tumble downwardly partway down the bank as it moves forwardly. The rise and fall of each chip and fine will vary, of course, but the result will be that the fines will have a greater opportunity to pass between the rollers.

Figure 13:
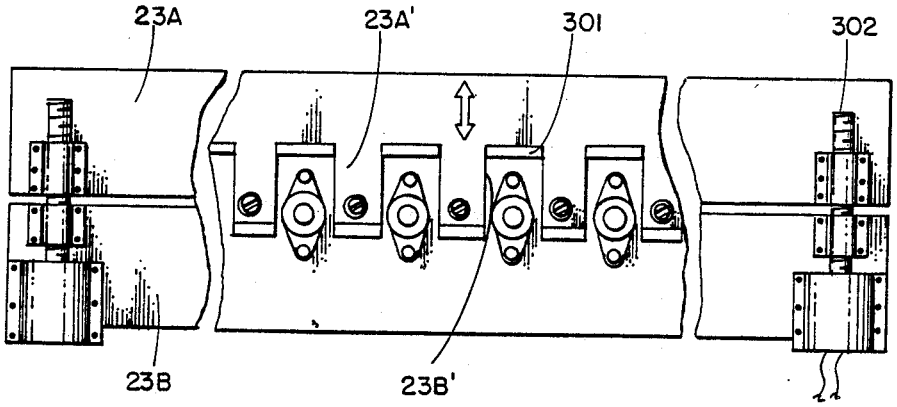
FIG. 13 is a fragmentary side view of an arrangement for varying the gap between the knurled rollers.
Figure 14:
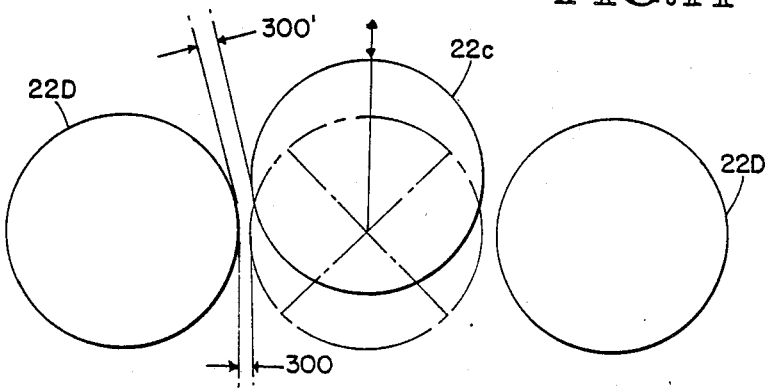
FIG. 14 is an end view illustrating the effect of elevating alternate of the knurled rollers.

In some instances, it may be desirable to be able to adjust the gap 300 between the knurled rollers 22. For example, it may be desired to use the equipment to sort chips after the fines have been removed. Adjustment of the gap 300 may be accomplished by raising alternate 22*c* of the rollers 22 relative to the remaining rollers 22*d* so that the gap is increased as indicated by 300' in FIG. 14. To make the gap adjustment between rollers, the side plates 23, 24 can be split, as indicated by side plates 23A, 23B in FIG. 13, and the meeting edges given a zigzag interfit by way of rectangular teeth 23A' and 23B'. Each such tooth is spaced at its end by a gap 301 from the adjacent portion of the adjoining side plate. The width of the gaps 301, and hence of the roller gaps 300, may be accomplished by jackscrews 302 acting between the side plate sections 23A, 23B. It will be understood that, preferably, the shafts for the rollers carried by one of the sets of side plate sections 23A, 23B will be chain driven, as previously described, at one side of the machine, and that the rollers carried by the other set will be driven at the other side.

It will be appreciated that the knurls 44 may have other shapes. For example, they may be made conical or frustoconical, as indicated by knurls 144 in FIG. 9, or shaped as shown by knurls 244 in FIG. 8 so that some of the spaces between knurls are generally vee-shaped and other are generally U-shaped.

The rotational speed of the rollers can be varied for maximum performance, depending upon the density, size and other characteristics of the wood chips being sorted. It has been found that roller rim speeds in the range of about 150 to 300 feet per minute give excellent results. Although the invention was made for handling wood chips, it will be understood that the invention is also applicable for separating other chip materials.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A machine for separating fines from wood chip material, said machine comprising:

a plurality of side-by-side coplanar rollers collectively providing a generally horizontal bed having its length extending transverse of said rollers between an infeed and a discharge end, said rollers having a minimum outer radius and a maximum outer radius, and having an outer circumferential surface area which extends across said bed and is provided with tapered chip-agitating protuberances separated by tapered valleys, said protuberances extending from said minimum outer radius to said maximum outer radius, the protuberances on adjacent rollers being spaced apart by a narrow protuberance gap for passage therethrough of fines only, and said valleys being shallow for receiving and passing fines through said bed by way of the valleys;

feed means for feeding wood chip material to said bed adjacent said infeed end; and drive means for turning said rollers in the same direction of rotation whereat the upper portions of the rollers turn toward said discharge end, whereby fines in the chip material fed to said bed will normally pass through said bed by way of said valleys and protuberance gap while the chip material is tumbled and conveyed by the rotating rollers along said bed for discharge at said discharge end.

2. A machine according to claim 1 in which said protuberances are generally pyramidal in shape.

3. A machine according to claim 1 in which said valleys have a depth of about one-tenth of an inch and have a maximum width of about one-quarter of an inch.

4. A machine according to claim 1 in which the valleys on the rollers occupy continuous crisscrossing spiral paths around the rollers.

5. A machine according to claim 1 in which said protuberance gap is less in width than the height of the protuberances on the rollers.

6. A method of separating fines from wood chip material, comprising:

feeding the material onto a bed provided by a plurality of knurled, closely spaced rollers through which only the fines in the material can pass by way of the spaces between the knurls on the rollers and narrow gaps between the rollers, said spaces being continuous endwise of the rollers; and rotating said rollers so that said knurls tumble and convey said material and only fines therein are caused to occupy said spaces and gaps and pass through the bed and the remainder of said material discharges from said bed without passing therethrough.

7. A method according to claim 6 in which said spaces between the knurls occupy crisscrossing spiral grooves in the rollers.

8. A method of separating fines from wood chip material, comprising:

feeding the wood chip material onto a bed formed by a plurality of side-by-side rollers each having a pattern of crisscrossing continuous grooves sized to receive only fines to be separated from the material, the spacing between said rollers being such that no chip material other than fines can pass between the rollers; and rotating said rollers in the same direction so that fines in the material pass through said bed while occupying said grooves and the remainder of said material discharges from said bed without passing therethrough.

9. A method according to claim 8 in which said grooves and knurls are tapered.

10. A method according to claim 8 in which said grooves have a depth of approximately one-tenth of an inch and an entrance width of approximately one-quarter of an inch.

11. A method of separating fines from chip material, comprising:

feeding the material onto a roller bed provided by a plurality of knurled, closely spaced, coplanar rollers through which only the fines in the material can pass by way of the spaces between the knurls on the rollers and narrow gaps between the rollers, said spaces being continuous in a direction generally endwise of the rollers; and rotating said rollers in the same direction of rotation so that said knurls tumble and convey said material toward a discharge end of the bed, the fines in the material occupy said spaces and gaps and pass through the bed, and the remainder of the chip material discharges from said discharge end of the bed.

12. A method according to claim 11 in which said spaces between the knurls occupy crisscrossing, spiral, tapered grooves in the rollers.

13. A method according to claim 11 in which said grooves have a depth of approximately one-tenth of an inch and an entrance width of approximately one-quarter of an inch.

14. A method of separating fines from wood chip material, comprising:

feeding the material onto a roller bed formed by a plurality of coplanar rollers spaced apart by narrow gaps and each having a surface pattern of generally pyramidal shaped protuberances separated by crisscrossing, spiral, tapered grooves of a depth and tapered width such that only fines can occupy the grooves and gaps to pass between the rollers and discharge beneath the bed; and rotating said rollers in the same direction of rotation so that said protuberances tumble and convey said material toward a discharge end of the bed, the fines in the material occupy said spaces and gaps and pass through the bed, and the remainder of the chip material discharges from said discharge end of the bed.

15. A method according to claim 14 in which said grooves have a depth of approximately one-tenth of an inch and an entrance width of approximately one-quarter of an inch, and said gaps are less than about six one-hundredths of an inch in width.

16. A method according to claim 14 in which said gaps are less than about six one-hundredths of an inch in width.

17. A method according to claim 14 in which said grooves have a depth of approximately one-tenth of an inch.

18. A method according to claim 14 in which said grooves have a maximum width of approximately one-quarter of an inch.

19. A method according to claim 14 in which the depth of said grooves is greater than the width of said grooves.

20. A machine for separating wood fines from wood chip material, said machine comprising:

a plurality of side-by-side coplanar rollers spaced apart by narrow gaps and collectively providing a generally horizontal bed having its length extending transverse of said rollers between an infeed end and a discharge end, each of said rollers having a surface pattern extending across said bed of generally pyramidal shaped protuberances separated by crisscrossing, spiral, tapered grooves of a depth and tapered width such that only fines can occupy the grooves and gaps to pass between the rollers and discharge beneath the bed;

feed means for feeding wood chip material to said bed adjacent said infeed end; and drive means for turning said rollers in the same direction of rotation whereat the upper portions of the rollers turn toward said discharge end, whereby fines in the chip material fed to said bed will normally pass through said bed by way of said grooves and gaps while the chip material is tumbled and conveyed by the protuberances on the rotating rollers along said bed for discharge at said discharge end.

21. A machine according to claim 20 in which said grooves have a depth of about one-tenth of an inch.

22. A machine according to claim 20 in which said gaps are less in width than the height of the protuberances on the rollers.

23. A machine according to claim 20 in which said grooves have a maximum width of about one-quarter of an inch.

24. A machine according to claim 20 in which said gaps are less than about six one-hundredths of an inch in width.

25. A machine according to claim 20 in which said grooves have a depth of approximately one-tenth of an inch and an entrance width of approximately one-quarter of an inch, and said gaps are less than about six one-hundredths of an inch in width.

26. A method of separating fines having one of their dimensions less than a given minimum dimension from wood chip material, comprising:

feeding the wood chip material into a bed formed by a plurality of side-by-side, knurled rollers spaced apart by narrow gaps of a width approximating said minimum dimension, the knurls on the rollers being defined by continuous grooves extending generally lengthwise of the rollers; and rotating said rollers in the same direction so that only fines in said material pass through said bed between the knurls on the rollers and through said gaps between the rollers and the remainder of said material discharges from said bed without passing therethrough.

27. A method of separating fines from wood chip material, comprising:

placing the material on a roller bed through which only the fines in the material can pass by way of recesses between knurls on the rollers forming the bed, said recesses being continuous in a direction generally endwise of said rollers; and rotating said rollers in one direction so that said knurls tumble and convey said material and fines therein are caused to occupy said recesses and pass through the bed and the remainder of said material discharges from said bed without passing therethrough.

28. A method of separating fines from wood chip material, comprising:

providing a plurality of side-by-side, knurled rollers forming a bed through which only the fines can pass, the knurls on said rollers being separated by valleys which are continuous in a direction generally endwise of the rollers, said bed having its length extending transversely of the length of said rollers and having an infeed end and a discharge end;

feeding the wood chip material onto said bed adjacent said infeed end; and rotating said rollers in one direction at a speed sufficient to tumble said wood chip material and convey it along said bed to cause fines in such material to pass through the bed and the remainder of said material to discharge from said discharge end.

29. A method of separating fines having one of their dimensions less than a given minimum dimension from wood chip material, comprising:

rotating in one direction a plurality of side-by-side rollers having a plurality of knurls defined by a plurality of crisscrossing continuous grooves in the rollers of a shape and size adapted to receive said fines, said rollers forming a bed and being spaced apart a distance between said knurls sufficient to pass only said fines therebetween; and feeding the wood chip material onto said bed and rotating said rollers at a speed sufficient for said knurls to tumble said material and said rollers to convey it along the bed transversely of the length of the rollers toward an end of said bed whereby only fines pass through said bed and the remainder of said material discharges from said end of the bed.

30. A method of separating fines from wood chip material, comprising:

feeding the material onto a roller bed formed by a plurality of coplanar rollers having a minimum outer radius and a maximum outer radius, said rollers being spaced apart by narrow gaps at their outer radius and each having a surface pattern of tapered protuberances extending from said minimum outer radius to said maximum outer radius and separated by tapered valleys such that only fines can occupy said valleys and gaps to pass between the rollers and discharge beneath the bed; and rotating said rollers in the same direction of rotation so that said protuberances tumble and convey said material toward a discharge end of the bed, the fines in the material occupy said spaces and gaps and pass through the bed, and the remainder of the chip material discharges from said discharge end of the bed.

* * * * *